United States Patent [19]

Cherrington

[11] 3,996,758

[45] Dec. 14, 1976

[54] METHOD FOR PLACEMENT OF PRODUCTION CASING UNDER OBSTACLE

[75] Inventor: Martin D. Cherrington, Sacramento, Calif.

[73] Assignee: Tidril Corporation, Sacramento, Calif.

[22] Filed: July 14, 1975

[21] Appl. No.: 595,829

[52] U.S. Cl. ..... 61/105; 61/72.7; 175/61

[51] Int. Cl.[2] ..... F16L 1/02; E02D 29/00

[58] Field of Search ..... 61/42, 72.1–72.7; 175/53, 62, 61

[56] References Cited

UNITED STATES PATENTS

| | | | |
|---|---|---|---|
| 2,656,683 | 10/1953 | Riva | 61/42 |
| 3,143,861 | 8/1964 | Dumas | 61/42 |
| 3,635,036 | 1/1972 | Hooper | 61/72.1 |
| 3,894,402 | 7/1975 | Cherrington | 61/72.4 |
| 3,902,563 | 9/1975 | Dunn | 175/62 |

OTHER PUBLICATIONS

Engineering News–Record, Jan. 5, 1950, p. 44.

*Primary Examiner*—Paul R. Gilliam
*Assistant Examiner*—David H. Corbin
*Attorney, Agent, or Firm*—Townsend and Townsend

[57] ABSTRACT

A system and method of installing a production casing along an inverted underground arcuate path beneath and spanning an obstacle such as a river is disclosed. The casing is installed along the inverted arcuate path of a pilot string occupying a pilot hole underlying the obstacle. The pilot hole spans the obstacle from a first position at or near ground level on one side of the obstacle to a second position at or near ground level on the other side. An oversized casing having an inner diameter greater than the outer diameter of the production casing is first advanced into and partially along the pilot hole from one side of the obstacle. The oversized casing is advanced along the path of the pilot hole until it becomes frozen in place or is substantially impeded typically by friction. The production casing is then advanced through the interior of the oversized casing along the extent of the path of the pilot hole occupied by the oversized casing and along the remainder of the path of the pilot hole to the other side of the obstacle. If desired, a second oversized casing can be advanced into and partially along the path of the pilot hole from the other side of the obstacle as well. When extremely wide obstacles are to be traversed, it may be desirable in addition to advance secondary oversized casings inside the initial oversized casings and along the path of the pilot hole until they too are substantially impeded by friction. In this manner, the production casing can be installed beneath and spanning extremely wide obstacles.

13 Claims, 7 Drawing Figures

METHOD FOR PLACEMENT OF PRODUCTION CASING UNDER OBSTACLE

BACKGROUND OF THE INVENTION

1. Field of the Invention

The present invention relates to a system and method for installing a production casing along an inverted underground arcuate path beneath and spanning an obstacle such as a river, and in particular to such as system and method for spanning extremely wide obstacles.

2. Description of the Prior and Contemporaneous Art

Techniques have recently been developed for installing relatively large diameter production casings beneath rivers and other obstacles without dredging the riverbed or otherwise affecting the obstacle itself. Instead, a pilot hole is first drilled along an inverted underground arcuate path from a position at or near ground level on one side of the obstacle to a position at or near ground level on the other side. After drilling the pilot hole, the pilot drill string remains in the hole. A reamer is then attached to one end of the drill string and is drawn or forced through the pilot hole to ream the pilot hole to a preselected larger diameter. The production casing or other large diameter casing is advanced into the reamed pilot hole in following relationship to the reaming apparatus. As a result, when the pilot hole has been reamed from one end to the other, the larger casing occupies the reamed hole.

The above techniques for placing production casings beneath obstacles have run into difficulties when relatively wide obstacles, such a major rivers, are to be traversed. The path of the production casing is generally horizontal, and the weight of the casing, and therefore the friction which must be overcome when it is moved, increases proportionate to the width of the obstacle. The casing can be sealed to make it buoyant in an attempt to counterbalance the weight of the casing, but it is extremely difficult to exactly balance the weight when long production casings are being installed. As a result, friction forces on the casing increase, and when a wide obstacle is to be traversed, the casing will eventually become frozen or substantially impeded by the friction between the casing and the reamed pilot hole and it will not completely span the obstacle.

SUMMARY OF THE INVENTION

The present invention provides a system and method of installing a production casing beneath and spanning an obstacle such as a river. The casing is installed along the inverted underground arcuate path of a pilot hole underlying the obstacle. The pilot hole spans the obstacle from a first position at or near ground level on one side of the obstacle to a second position at or near ground level on the other side. An oversized casing having an inner diameter greater than the outer diameter of the production casing is first advanced into and partially along the pilot hole from one side of the obstacle. The oversized casing is advanced along the path of the pilot hole until it becomes frozen in place or is substantially impeded. The production casing is then advanced through the interior of the oversized casing along the extent of the path of the pilot hole occupied by the oversize casing and along the remainder of the path of the pilot hole to the other side of the obstacle.

If desired, a second oversized casing can be advanced into and partially along the path of the pilot hole from the other side of the obstacle as well. When extremely wide obstacles are to be traversed, it may be desirable in addition to advance secondary oversized casings inside the intial oversized casings and along the path of the pilot hole until they too are substantially impeded. In this manner, the production casing can be installed beneath and spanning extremely wide obstacles.

The system and method of the present invention provide several techniques which can be used alone or in combination to install a production casing spanning relatively wide obstacles.

The first technique is to install an initial oversized casing along the path of the pilot hole until the installaiton of that casing becomes substantially impeded, usually by friction. Thereafter, the production casing is installed through the interior of the oversized casing and along the remainder of the pilot hole.

In the second technique, such oversized casings are installed on both sides of the obstacle until advancing of both oversized casings becomes impossible. The production casing is then installed through one of the oversized casings, through the portion of the pilot hole not occupied by either oversized casing, and thereafter through the remaining oversized casing to span the hole. The pilot drill string guides the placement of the casings so that they are aligned along the path of the pilot hole and the production casing will engage the respective oversized casings.

The third technique is to place a first oversized casing as far as possible along the path of the pilot hole from one side and then insert a second oversized casing within the first oversized casing and as far as possible along the remainder of the path of the pilot hole. The production casing is inserted through the interior of the second oversized casing along the remainder of the pilot hole. This third technique can be used in combination with the second technique to span extremely wide obstacles.

The object of the above-mentioned techniques is to limit the distance which must be spanned by the production casing in direct contact with the ground and without a circumscribing oversized casing. The distance in which the casing is in direct contact with the ground is limited to that distance which can be traversed by the production casing without encountering sufficient friction to prevent the further installation of the casing. Such casings are typically constructed of steel, and the steel on steel friction between two casings is far less than the friction between a single casing and the ground. By reducing the distance along which the production casing is installed in direct contact with the ground and increasing the distance along which the production casing is circumscribed by an oversized casing according to the teachings of the present invention, the overall friction on the production casing is reduced. As a result, the production casing can be installed beneath and spanning extremely wide obstacles.

The oversized casings used in the system and method of the present invention to aid in the installation of the production casing are of little value after the production casing is actually installed. It is usually not practical to remove these oversized casings from the hole after the production casing is installed, and accordingly, it is advantageous to minimize the size and length of the oversized casings used. It is therefore preferred to install oversize casings from both sides of the obstacle when the use of a single oversized casing from one side of the obstacle will not permit installation of the production casing completely spanning the obstacle. In this manner, the oversized casings need not overlap one another, or the amount of such oversized casing which does overlap is minimized, to reduce the size and length of oversized casings necessary for the installation of the production casing.

The novel features which are believed to be characteristic of the invention, both as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
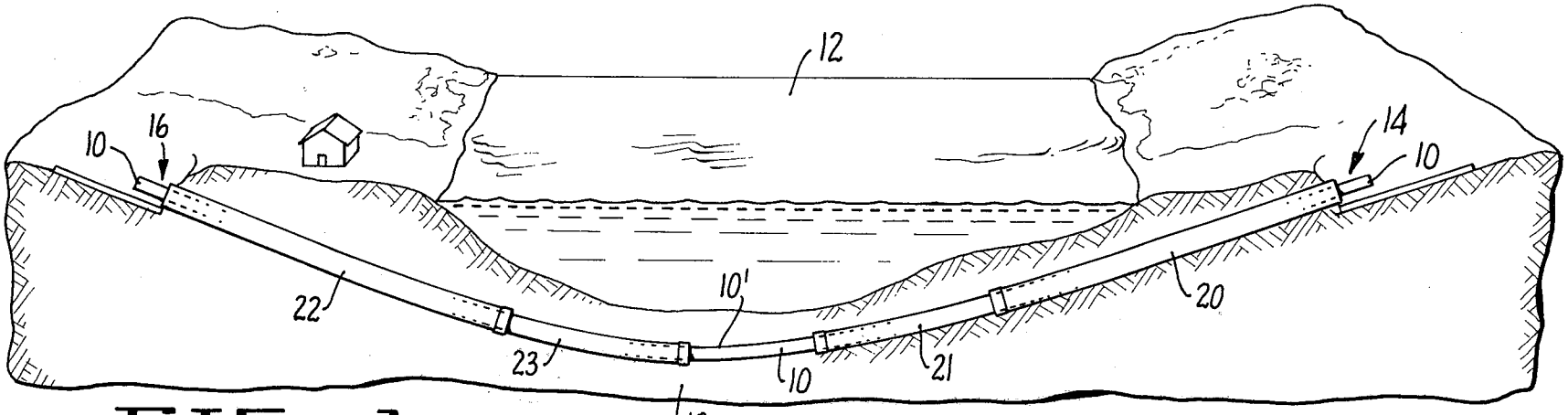
FIG. 1 is a perspective and partial section view of a production casing installed according to the teachings of the present invention.

A production casing 10 installed according to the teachings of the present invention along an inverted underground arcuate path spanning a river 12 is illustrated in FIG. 1. Casing 10 extends from a first position 14 at or near ground level on one side of river 12 to a second position 16 at or near ground level on the other side of the river. See my U.S. Pat. No. 3,878,903 issued Apr. 22, 1975 entitled Apparatus And Method For Drilling Underground Arcuate Paths. Although a river crossing is illustrated by way of example, the present invention can also be used to span other obstacles such as highways as well.

The center portion 10' of production casing 10 is in direct contact with ground 18. However, on both sides of this center portion, production casing 10 is circumscribed by overlapping oversized casings 20–23. The inner and outer diameters of oversized casings 20–23 are selected so that the casings will nest in the overlapping relationship illustrated. Oversized casings 20–23 allow production casing 10 to be installed spanning relatively wide obstacles, as discussed hereinbelow. (It should be noted that the widths of production casing 10 and oversized casings 20–23 are greatly exaggerated in the figures for clarity.)

SEQUENCE OF OPERATIONS

Figure 2:
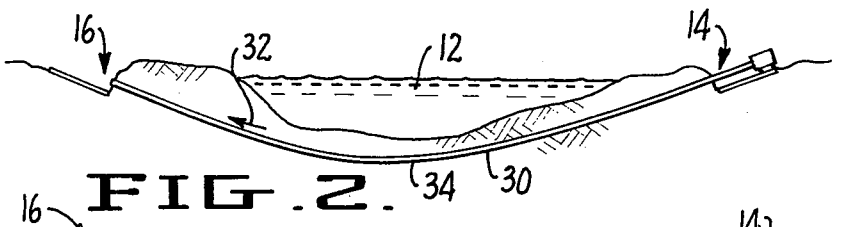
FIG. 2 is a schematic view illustrating the first step of the preferred embodiment of the present invention in which a pilot hole is drilled beneath the obstacle.

The initial step in the installation of a production casing 10 according to the teachings of the present invention is the drilling of a pilot hole 30 beneath and spanning river 12 as illustrated in FIG. 2. Pilot hole 30 is drilled from first position 14 at one side of river 12 to second position 16 at the other side thereof. In order to pass beneath river 12, pilot hole 30 is drilled along an inverted underground arcuate path from position 14 to position 16, as illustrated by arrow 32. Techniques for drilling pilot hole 13 along the inverted arcuate path are disclosed in my U.S. Pat. No. 3,878,903 issued Apr. 22, 1975 for Apparatus And Process For Drilling Underground Arcuate Paths.

In drilling pilot hole 30, a drill bit is used which is operated by a trailing drill string 34. After pilot hole 30 is completed, drill string 34 is left in the pilot hole to provide a guide for the installation of the production casing.

Figure 3:
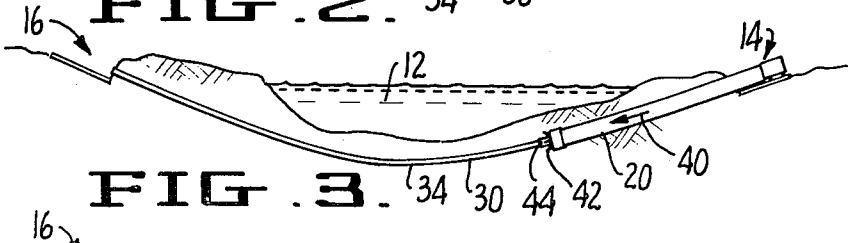
FIG. 3 is a schematic view illustrating the second step of the preferred embodiment of the present invention wherein a first oversized casing is installed from one side of the obstacle.
Figure 7:
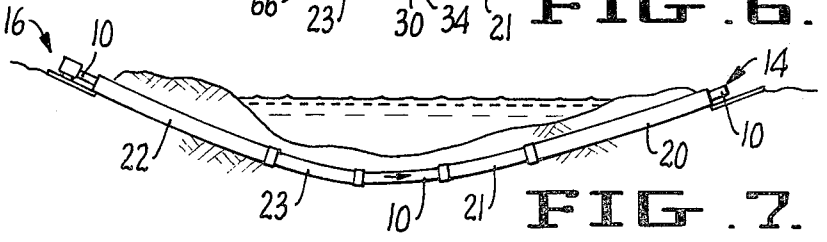
FIG. 7 is a schematic view of the final step of the preferred embodiment of the present invention in which the production casing is installed beneath and spanning the obstacle.

The second step of the preferred embodiment of the present invention is illustrated by way of reference to FIG. 3. In this second step, oversized casing 20 is crowded either rotatably or nonrotatably into the ground along the path of pilot hole 30 circumscribing drill string 34, as illustrated by arrow 40. It is preferred that casing 20 be advanced nonrotatably to minimize stresses on the curved casing, especially if it has a large diameter, and precurved casings may be used which cannot be rotated. In the preferred embodiment of the present invention, oversized casing 20 is crowded along pilot hole 30 from position 14 at the first side of river 12. However, it is apparent that installation of the oversized casing could be initiated at position 16 on the other side of river 12 if desired without departing from the teachings of the present invention.

It is preferred that first oversized casing 20 be advanced into the hole in following relationship to a reamer 42. Reamer 42 may be mounted to and operated by a rotated washover pipe 44. Various techniques for advancing oversized casing 20 into and along pilot hole 30 are illustrated in my patent for Apparatus And Process For Emplacing A Conduit Along An Underground Arcuate Path, U.S. Pat. No. 3,894,402 issued July 15, 1975 and my copending patent application for Ser. No. 595,830 filed July 4, 1975. However, other such techniques in which a large diameter casing is installed along the path of a pilot hole can be used as well.

When an attempt is made to install a large diameter casing such as oversized casing 20 beneath an obstacle, the friction between the casing and the sidewalls of the reamed pilot hole increases as the length of the casing increases. When relatively narrow obstacles are to be traversed, it is possible to install a production casing completely spanning the obstacle in a single step because the friction on the casing does not increase to the point where the casing can no longer be advanced. However, when relatively wide obstacles are to be traversed, the friction on the casing will increase to the point where the casing is frozen in place or is substantially impeded by friction so that it is no longer feasible to advance the casing further. The present invention deals with such situations, and when oversized casing 20 has been advanced along the path of pilot hole 30 to the point where further advancing of the casing is substantially impeded, advancing of that casing is terminated.

Figure 4:
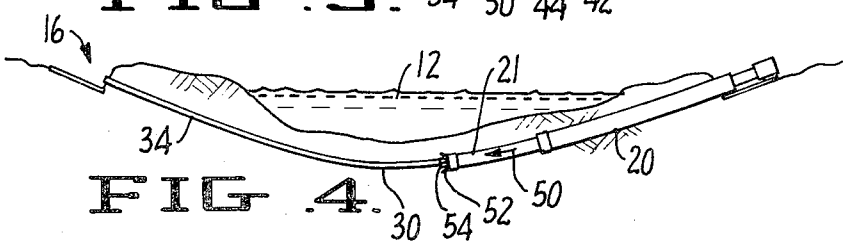
FIG. 4 is a schematic view of the third step of the preferred embodiment of the present invention in which a second oversized casing is installed from the first side of the obstacle.

After first oversized casing 20 has been advanced as far as possible, second oversized casing 21 is advanced through the interior of oversized casing 20 and along a portion of the remainder of the path of pilot hole 30 as illustrated by arrow 50 in FIG. 4. Both oversized casings 20 and 21 are typically constructed of steel. When oversized casing 21 passes through the interior of oversized casing 20, the steel on steel friction will be substantially less than the friction which would be present when a casing is advanced in direct contact with the ground, and casing 21 will slip smoothly along casing 20.

When oversized casing 21 reaches the end of oversized casing 20, it is advanced along the path of pilot hole 30 using the techniques described above. Typically, casing 21 is advanced in following relationship to a reamer 52 mounted on an operated by a washover pipe 54. Oversized casing 21 is advanced in this manner until friction between the casing and the ground renders further advancing of the casing unfeasible, and at that point the advancing of oversized casing 21 is terminated.

Figure 5:
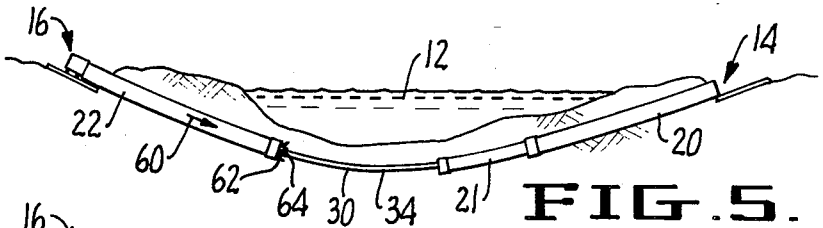
FIG. 5 is a schematic view illustrating the fourth step of the preferred embodiment of the present invention in which an oversized production casing is installed from the second side of the obstacle.

After termination of the advancing of oversized casings 20–21 from position 14 on the first side of river 12, another oversized casing 22 is advanced into and along pilot hole 30 from position 16 on the other side of the river (See FIG. 5). Oversized casing 22 is advanced into and along pilot hole 20 as illustrated by arrow 60 using the techniques discussed above. Again, such techniques may employ a reamer 62 mounted on and operated by a washover pipe 64. Oversized casing 22 is advanced into and along pilot hole 30 circumscribing drill string 34 until further advancement thereof is substantially impeded by friction at which point further advancing of the casing is terminated.

Figure 6:
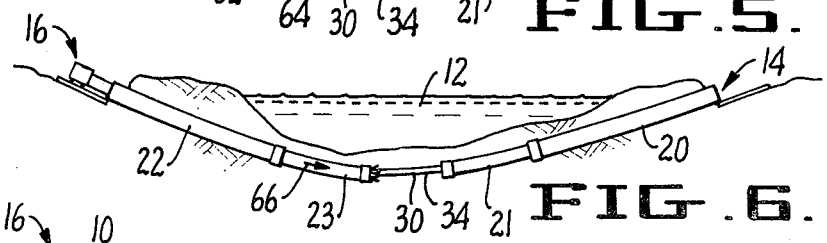
FIG. 6 is a schematic view illustrating the fifth step of the preferred embodiment of the present invention in which a second production casing is installed from the second side of the obstacle.

Oversized casing 23 is thereafter installed through the interior of oversized casing 22 and along the path of pilot hole 30 circumscribing drill string 34 as illustrated in FIG. 6. Again, oversized casing 23 is advanced along pilot hole 30 as illustrated by arrow 66 until it too is substantially impeded by friction.

After installation of oversized casings 20–23, a center portion of the pilot hole 30 remains to be spanned by a larger casing. However, when the portion of the pilot hole which remains is sufficiently short so that a single casing can traverse that distance without being frozen or substantially impeded by friction, further installation of oversized casings is discontinued. Instead, the production casing 10 itself is advanced into and along the pilot hole through the interior of oversized casings 22 and 23 from position 16 (or position 14), through the center portion of the pilot hole using techniques outlined above and thereafter through the interior of casings 21 and 20 to completely span river 12.

The path of each casing is controlled by drill string 34, and thus each casing follows the desired inverted underground arcuate path. In addition, drill string 34 guides production casing 10 as it is installed so that it mates with oversized casing 21 near the center of the obstacle. It is anticipated that each casing 10 and 20–23 will be advanced along the pilot hole circumscribing drill string 34. However, it is possible one or more of the casings, such as production casing 10, will be attached to the drill string so that the drill string moves through the hole as the attached casing is being advanced thereinto.

It is apparent that the system and method of the present invention comprise several techniques which enable a production casing to be installed beneath and spanning wide obstacles. These techniques can be summarized as (a) installing an initial oversized casing along part of the path to be traversed and thereafter installing the production casing along the entire path; (b) installing such oversized casings from each side of the obstacle; and (c) overlapping two or more oversized casings before installation of the production casing. These techniques can be used individually or in combination to achieve the objects of the present invention.

One of the objectives of the present invention is to enable the production casing to be installed using a minimum quantity of oversized casings. Such oversized casings can ordinarily not be retrieved from the hole once they have been used and are essentially wasted. Accordingly, the use of overlapping oversized casings should be minimized, which usually results when approximately equal numbers of oversized casings are installed from each side of the obstacle. For example, if the preferred embodiment of the present invention were modified so that all four oversized casings were installed from one side of the obstacle in an overlapping arrangement, both the length of the casings used and the diameter of the initial casings would have to be increased. By using approximately equal numbers of oversized casings from each side of the obstacle overlapping of the oversized casings themselves is minimized to increase the efficiency of the installation process.

While a preferred embodiment of the system and method of the present invention have been illustrated in detail, it is apparent that modifications and adaptations of that embodiment may occur to those skilled in the art. In particular, it is apparent that the sequence of steps could be modified, and that the techniques outlined above can be used in different combinations. In this regard it should be noted that when the terms "first", "second" and so on and similar terms are used in the claims, these terms do not necessarily designate the temporal order in which the items so designated are to be used. It is to be expressly understood that such modifications and adaptations are within the spirit and scope of the present invention, as set forth in the following claims.

What is claimed is:

1. A method of installing a tubular production casing in ground having frictional resistance to the advancement of a casing through the ground, said tubular production casing extending beneath and spanning an obstacle such as a river along the inverted underground arcuate path of a pilot hole occupied by a drill string underlying the obstacle and spanning the obstacle from a first position at or near ground level on a side of said obstacle to a second position at or near ground level on the opposite side thereof, said production casing having an inner diameter greater than the diameter of the drill string and an outer diameter, said method comprising the steps of advancing a tubular oversized casing into the pilot hole from one side of the obstacle and partially along said pilot hole until advancing said oversized casing along the path of the pilot hole is substantially impeded by friction between said oversized casing and encountered ground, the inner diameter of said oversized casing being greater than the outer diameter of the production casing; and advancing the production casing from said one side of the obstacle through the interior of the oversized casing along the extent of the path of the pilot hole occupied by the oversized casing and along the remainder of the path of the pilot hole to the other side of the obstacle so that the production casing is installed beneath and spanning the obstacle.

2. A method as recited in claim 1 wherein said advancing steps include advancing the oversized casing and the production casing into and along the pilot hole in circumscribing relationship to the drill string.

3. A method as recited in claim 1 and additionally comprising the step of advancing a second oversized casing into the pilot hole from said other side of the obstacle so that the production casing is advanced first through the first oversized casing and thereafter through said second oversized casing to span the obstacle.

4. A method as recited in claim 1 and additionally comprising the step of advancing a second oversized casing having an outer diameter less than the inner diameter of the first oversized casing and an inner diameter greater than the outer diameter of the production casing from said one side of the obstacle through the interior of the first oversized casing along the extent of the path of the pilot hole occupied by said first oversized casing and along a portion of the remainder of the path of the pilot hole in circumscribing relationship to the drill string until advancing said second oversized casing is substantially impeded by friction between said second oversized casing and encountered ground to allow for advancing of the production casing from one side of the obstacle through the interior of the second oversized casing and along the remainder of the path of the pilot hole to the other side of the obstacle.

5. A system for installing a tubular production casing in ground having frictional resistance to the advancement of a casing through the ground, said tubular production casing extending beneath and spanning an obstacle such as a river along the inverted underground arcuate path of a pilot hole occupied by a drill string underlying the obstacle and spanning said obstacle from a first position at or near ground level on a side of the obstacle to a second position at or near ground level on the opposite side thereof, said system comprising a tubular oversized casing having an inner diameter greater than the outer diameter of the production casing; means for advancing the oversized casing into the pilot hole from said one side of the obstacle and partially along said pilot hole in circumscribing relationship to said drill string until advancing of said oversized casing is substantially impeded by friction between said oversized casing and encountered ground and means for advancing the production casing from one side of the obstacle through the interior of the oversized casing along the extent of the path of the pilot hole occupied by the oversized casing and along the remainder of the path of the pilot hole to said other side of the obstacle in circumscribing relationship to said drill string so that the production casing is installed beneath and spanning the obstacle.

6. A system as recited in claim 5 and additionally comprising a second tubular oversized casing having an outer diameter less than the inner diameter of the first oversized casing and an inner diameter greater than the outer diameter of the production casing, and means for advancing the second oversized casing through the interior of the first oversized casing along the extent of the path of the pilot hole occupied by the first oversized casing and along a portion of the remainder of the path of the pilot hole until the advancing of said second oversized casing is substantially impeded by friction between said oversized casing and encountered ground, and wherein said production casing advancing means comprises means for advancing the production casing through the interior of the second oversized casing along the extent of the path occupied by the second oversized casing and along the remainder of the path of the pilot hole.

7. A system as recited in claim 5 and additionally comprising a secont tubular oversized casing, and means for advancing the second oversized casing into the pilot hole from said other side of the obstacle and partially along said pilot hole until advancing said second oversized casing is substantially impeded by friction between said oversized casing and encountered ground and wherein the production casing advancing means includes means for advancing the production casing through the interior of the first oversized casing and thereafter through the interior of the second oversized casing to span the obstacle.

8. A method of installing a tubular production casing in ground having frictional resistance to the advancement of a casing through the ground, said casing extending beneath and spanning an obstacle such as a river along the inverted underground arcuate path of a pilot hole occupied by a drill string underlying the obstacle and spanning the obstacle from a first position at or near ground level on one side of the obstacle to a second position at or near ground level on the other side therof, said method comprising the step of advancing a first tubular oversized casing into the pilot hole from said one side of the obstacle and partially along said pilot hole in circumscribing relationship to the drill string until advancing said first oversized casing along the path of the pilot hole is substantially impeded by friction between said first oversized casing and encountered ground, the inner diameter of said first oversized casing being greater than the outer diameter of the production casing; advancing a second tubular oversized casing into the pilot hole from said other side of the obstacle and partially along said pilot hole in circumscribing relationship to the drill string until advancing said second oversized casing along the path of the pilot hole is substantially impeded by friction between said second oversized casing and encountered ground, the inner diameter of said second oversized casing being greater than the outer diameter of the production casing; and advancing the production casing from one of said sides of the obstacle through the interior of one of the oversized casings along the extent of the path of the pilot hole occupied by said one oversized casing in circumscribing relationship to said drill string and thereafter through the interior of the center of said oversized casings so that the production casing is installed beneath and spanning the obstacle.

9. A method as recited in claim 8 and additionally comprising the step of advancing a third tubular oversized casing having an outer diameter less than the inner diameter of the first oversized casing and an inner diameter greater than the outer diameter of the production casing from said one side of the obstacle through the interior of the first oversized casing along the extent of the path of the pilot hole occupied by said first oversized casing and along a portion of the remainder of the path of the first pilot hole until advancing said third oversized casing is substantially impeded by friction between said third oversized casing and encountered ground to allow for advancing of the production casing through the interior of the third oversized casing and the interior of the second oversized casing to span the obstacle.

10. A method of installing a tubular production casing in ground having frictional resistance to the advancement of a casing through the ground, said tubular production casing extending beneath and spanning an obstacle such as a river along the inverted underground arcuate path of a pilot hole occupied by a drill string underlying the obstacle and spanning the obstacle from a first position at or near grond level on one side of the obstacle to a second position at or near ground level on the other side thereof, said method comprising the steps of advancing a first tubular oversized casing into the pilot hole from said one side of the obstacle and partially along said pilot hole in circumscribing relationship to the drill string until advancing said first oversized casing along the path of the pilot hole is substantially impeded by friction between said first oversized casing and encountered ground, the interior diameter of said oversized casing being greater than the outer diameter of the production casing; advancing a second tubular oversized casing having an outer diameter less than the inner diameter of the first oversized casing and an inner diameter greater than the outer diameter of the production casing from said one side of the obstacle through the interior of the first oversized casing along the extent of the path of the pilot hole occupied by said first oversized casing and along a portion of the remainder of the path of the pilot hole in circumscribing relationship to the drill string until advancing said second oversized casing is substantially impeded by friction between said second oversized casing and encountered ground; advancing a third tubular oversized casing into the pilot hole from said other side of the obstacle in circumscribing relationship to the drill until advancing said third oversized casing along the path of the pilot hole is substantially impeded, by friction between said third oversized casing and encountered ground, the inner diameter of said third oversized casing being greater than the outer diameter of the production casing; and advancing the production casing through both the interior of the second oversized casing and the interior of the third oversized casing in circumscribing relationship to the drill string to span the obstacle.

11. A method as recited in claim 10 wherein the production casing advancing step includes advancing the production casing from said one side of the obstacle through the interior of the second oversized casing and thereafter through the interior of the third oversized casing.

12. A method as recited in claim 10 wherein said production casing advancing step includes advancing the production casing from said other side of the obstacle through the interior of the third oversized casing and thereafter through the interior of the second oversized casing.

13. A step as recited in claim 10 and additionally comprising the ste of advancing a fourth tubular oversized casing having an outer diameter less than the inner diameter of the third oversized casing and an inner diameter greater than the outer diameter of the production casing from said other side of the obstacle through the interior of the third oversized casing along the extent of the path of the pilot hole occupied by said third oversized casing and along a portion of the remainder of the path of the pilot hole in circumscribing relationship to the drill string until advancing said fourth oversized casing is substantially impeded by friction between said fourth oversized casing and encountered ground to allow for advancing of the production casing through the interior of the second and fourth oversized casings to span the obstacle.

* * * * *